United States Patent [19]

Hamaoka et al.

[11] 4,273,864

[45] Jun. 16, 1981

[54] COLOR PHOTOGRAPHIC LIGHT-SENSITIVE MATERIALS

[75] Inventors: Tsutomu Hamaoka; Masakazu Morigaki; Satoru Sawada; Takayoshi Kamio; Kotaro Nakamura, all of Minami-ashigara, Japan

[73] Assignee: Fuji Photo Film Co., Ltd., Minami-ashigara, Japan

[21] Appl. No.: 105,485

[22] Filed: Dec. 20, 1979

[30] Foreign Application Priority Data

Dec. 28, 1978 [JP] Japan ..... 53-165359

[51] Int. Cl.[3] ..... G03C 1/40

[52] U.S. Cl. ..... 430/551; 430/554; 430/555

[58] Field of Search ..... 430/551, 372, 554, 555

[56] References Cited

U.S. PATENT DOCUMENTS

| | | | |
|---|---|---|---|
| 2,735,765 | 2/1956 | Loria et al. | 430/551 |
| 3,907,571 | 9/1975 | Arai et al. | 430/555 |
| 3,982,944 | 9/1976 | Ohi et al. | 430/551 |

*Primary Examiner*—J. Travis Brown

*Attorney, Agent, or Firm*—Sughrue, Rothwell, Mion, Zinn and Macpeak

[57] ABSTRACT

A color photographic light-sensitive material comprising a support having thereon a silver halide emulsion layer containing a 3-anilino-5-pyrazolone type magenta coupler and at least one of the compounds represented by the formula (I)

(I)

wherein $R_1$ and $R_2$ represent each a tertiary alkyl group having 4 to 20 carbon atoms.

7 Claims, No Drawings

COLOR PHOTOGRAPHIC LIGHT-SENSITIVE MATERIALS

BACKGROUND OF THE INVENTION

1. Field of the Invention

The present invention relates to silver halide color photographic light-sensitive materials and, particularly, to the prevention of fading of magenta dye image obtained by development of color photographic light-sensitive materials comprising 3-anilino-5-pyrazolone type magenta type magenta couplers with a p-phenylenediamine type color developer and to prevention of discoloration of uncolored parts (referred to as white areas hereafter).

2. Description of the Prior Art

Generally, color images obtained by photographic processing of silver halide color photographic light-sensitive materials are composed of azomethine dyes or indoaniline dyes formed by the reaction of oxidation products of aromatic primary amine developing agents and couplers. The obtained color photographic images are stored or exhibited for a long period of time. However, since they are not always stable to light, heat or humidity, fading or discoloration of the dye images or discoloration of white areas generally results in deterioration of image quality, when they are exposed to light for a long period of time or stored at a high temperature and a high humidity.

The fading and discoloration of the images are fatal defects for the recording materials. To remove these defects, it has been proposed to use couplers having a low fading property, to use fading inhibitors to prevent fading by light or to use ultraviolet ray absorbing agents to prevent deterioration of images by ultraviolet rays. For example, known methods use magenta couplers such as described in U.S. Pat. No. 3,519,429, o-hydroxycoumarins such as described in U.S. Pat. No. 3,432,300, fading inhibitors having a phenolic hydroxyl group such as described in U.S. Pat. No. 3,698,909, and alkyl ethers such as described in Japanese Patent Application (OPI) No. 77526/78.

These compounds have either a poor effect as agents for preventing fading or discoloration of dye images and cause deterioration of color hue, fogging, inferior dispersion or formation of crystals. Accordingly, color image stabilizing agents which exhibit a synthetically excellent photographic effect have not been known.

SUMMARY OF THE INVENTION

An object of the present invention is to provide color photographic light-sensitive materials in which color images obtained from 3-anilino-5-pyrazolone type couplers are stabilized and color contamination of the white areas is remarkably limited by incorporating a dye image stabilizing agent having a sufficient fading preventing effect or prevent discoloration of the dye image without deteriorating the color hue or fogging the photographic light-sensitive layer.

As a result of various studies, the present inventors have found that the object of the present invention can be attained by incorporating at least one of compound represented by the following general formula (I) in a photographic layer.

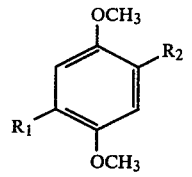

(I)

In the formula, $R_1$ and $R_2$ each represent a tertiary alkyl group having 4 to 20 carbon atoms inclusive of carbon atoms inclusive of carbon atoms in the substituent, (for example, tertbutyl, tert-pentyl, tert-hexyl or tert-octyl, etc.) which may be substituted by an aryl group, a cycloalkyl group, a hydroxyl group, an alkoxy group, or halogen atoms.

DETAILED DESCRIPTION OF THE INVENTION

Examples of the compounds represented by the general formula (I) used in the present invention follow. The present invention is not limited to the use of these compounds alone.

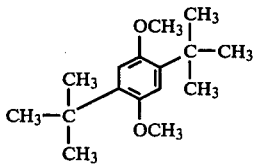

Compound (1)

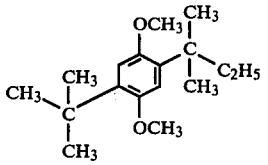

Compound (2)

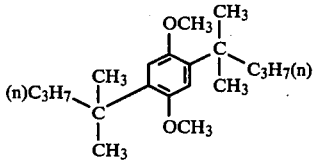

Compound (3)

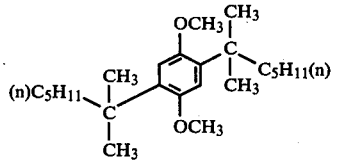

Compound (4)

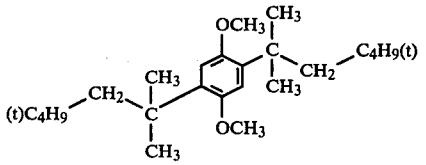

Compound (5)

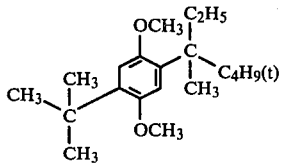

Compound (6)

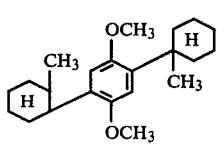

Compound (7)

-continued

Compound (8)

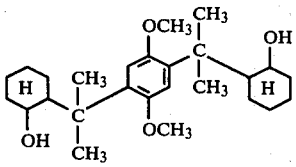

Compound (9)

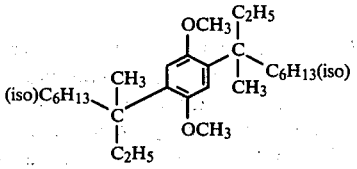

Compound (10)

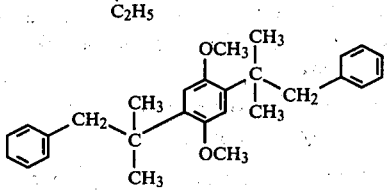

Compound (11)

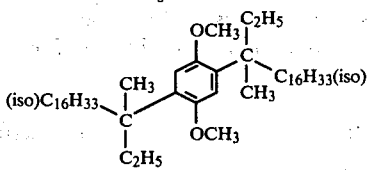

Compound (12)

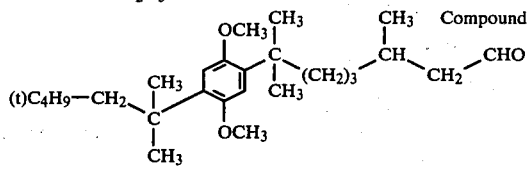

Of the compounds of formula (I) those in which the tertiary alkyl groups contain 6 to 10 carbon atoms are particularly preferred.

The compounds of the present invention represented by the formula (I) can be synthesized by a process which comprises introducing tertiary alkyl groups into corresponding alkyl hydroquinone after methylation or a process which comprises methylating hydroquinone after the introduction of the tertiary alkyl groups.

1. Synthesis of Compound (2)

To a solution prepared by dissolving 100 g of 2,5-di-(t)-amylhydroquinone and 183 g of methyl iodide in 300 ml of ethanol, 67 g of caustic potash dissolved in 40 ml of water is slowly added in a nitrogen atmosphere keeping the reaction temperature at 20° to 40° C. After addition, the mixture was heated to 72° C. to react for 3 hours. The crystals which precipitated were collected by filtration. After recrystallization from 600 ml of ethanol, 76 g of Compound (2) was obtained. Melting point: 104° to 108° C.

Elemental analysis for $C_{18}H_{30}O_2$— Calculated: C: 77.65, H: 10.86. Found: C: 77.43, H: 10.85.

2: Synthesis of Compound (3)

188 g of 2,5-bis{2-(2-methylpentyl)}hydroquinone and 312 g of methyl iodide were dissolved in 340 ml of ethanol in a nitrogen atmosphere and 115 g of caustic potash were dissolved in 168 ml of water and added dropwise thereto keeping the temperature at 40° C. or less. The reaction solution is poured into 5 liters of ice-water. Separated white solid were collected by filtration and recrystallized using 500 ml of ethanol to obtain 120 g of Compound (3). Melting point: 54° to 55° C.

Elemental analysis for $C_{18}H_{34}O_2$— Calculated: C: 78.38, H: 11.18. Found: C: 78.24, H: 11.09.

3: Synthesis of Compound (5)

133 g of 2,5-bis{2-(2,4,6-trimethylpentyl)}hydroquinone and 183 g of methyl iodide were dissolved in 300 ml of ethanol in a nitrogen atmosphere, and 68 g of caustic potash were dissolved in 40 ml of water and added dropwise keeping the temperature at 40° C. or less. After reaction at 35° to 40° C. for 4 hours, the reaction solution was poured into 2 liters of ice water and the separated white crystals were removed by filtration. The crude product was recrystallized using 200 ml of acetone to obtain 83 g of Compound (5). Melting point: 103° to 104° C.

Elemental analysis for $C_{24}H_{42}O_2$— Calculated: C: 79.50, H: 11.68, Found: C: 79.82, H: 11.63.

The compounds used in the present invention have very high solubility in solvents having a high boiling point such as dibutyl phthalate or tricresyl phosphate, etc. and do not separate during storage. The compounds used in the present invention do not cause fog and prevent fading of magenta dye images and discoloration of the white areas. Accordingly, they are dye image stabilizing agents which exhibit an excellent effect.

As will be shown in the Examples, this effect is peculiar since it is notably shown with benzenes having methoxy groups at the 1 and 4 positions and tertiary alkyl groups at positions ortho to them but is not shown with benzenes having hydroxyl groups, ethoxy groups, butoxy groups or other alkoxy groups at the 1 and 4 positions and/or primary or secondary alkyl groups at positions ortho to them.

The amount of the compounds used in the present invention varies with the coupler combined therewith, however, a preferred amount is about 0.5 to 200% by weight and most preferably 2 to 150% by weight based on the coupler. Amounts lower than this are not suitable for practical use, because the fade preventing or coloration of the white areas is very poor. If higher amounts are used, there is a possibility of impeding development and to deteriorate the color density.

In carrying out the present invention, known fading inhibitors may be used together with the compounds of formula (I). Further, the compounds of formula (I) may be used alone or in combinations of two or more.

Examples of conventional fading inhibitors, which can be combined with Compound (I) are phenol compounds such as 2,6-di-tert-butylphenol derivatives like 4-methyl-2,6-di-tert-butylphenol, 4-ethyl-2,6-di-tert-butylphenol and 4-hydroxymethyl-2,6-di-tert-butylphenol; gallic acid derivatives like ethyl gallate and propyl gallate; p-alkoxyphenol derivatives like 2-(tert)-butyl-4-methoxyphenol and 4-benzyloxy-2-(tert)-octylphenol, bis-phenol derivatives like 2,2'-methylenebis(6-(tert)-butyl-4-methylphenol) and 1,1'-bis(4-hydroxyphenyl)cyclohexane; O-hydroxybenzylamine derivatives like 2-hydroxy-3-methoxybenzylamine-N,N-diacetic acid; aminophenol derivatives like 4-aminophenol, 4-phenylaminophenol and 2-chloro-4-dodecylaminophenol; hydroquinone derivatives like 2-(tert)-octylhydroquinone and 2,5-di-(tert)-octylhydroquinone; or α-tocopherol derivatives like α-tocopherol, γ-tocopherol and δ-tocopherol as described in U.S. Pat. No. 2,360,290; 5-hydroxycoumaran derivatives like 6-(tert)-butyl-3,3-dimethyl-5-hydroxy-2-morpolinocoumaran and 6-(tert)-butyl-3,3-dimethyl-2-ethoxy-5-hydroxycoumaran as described in U.S. Pat. No. 3,573,050; 6-hydroxychroman derivative like 2,2-dimethyl-4-(iso)-propyl-6-hydroxy-7-(tert)-butylchroman and 2,2,4-trimethyl-6-hydroxy-7-(tert)-octylchroman as described in U.S. Pat. No. 3,432,300 and 6,6'-dihydroxy-4,4,4',4'-tetramethyl-2,2'-spirochroman as described in U.S. Pat. No. 3,764,337, etc.

In general, the magenta coupler is used in an amount of 5 to 50 mol%, preferably 10 to 30 mol% per mol of silver halide.

Examples of the 3-anilino-5-pyrazolone magenta couplers used in the present invention include compounds represented by the following general formula (II)

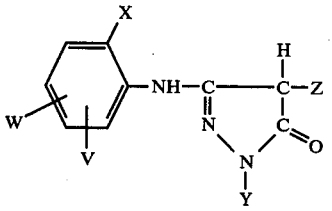

(II)

These 3-anilino-5-pyrazolone type magenta couplers are described in, for example, U.S. Pat. Nos. 3,684,514, 3,419,391, 3,615,506, 3,677,764, 3,907,571, 3,928,044, 3,935,015 and 3,658,544, British Pat. Nos. 1,183,515, 956,261, 1,249,287, 1,399,306, 968,461, 1,234,269 and 1,470,552, Japanese Patent Publications Nos. 6031/65 and 15754/69 and German Patent Application (OLS) No. 2,133,655.

In the formula, X represents a straight chain, branched chain or cyclic alkyl group (for example, a methyl group, an ethyl group, a tert-butyl group, a cyclohexyl group, an octyl group or a dodecyl group, etc.), a substituted or unsubstituted aryl group (for example, a phenyl group or a tolyl group, etc.), a straight chain, branched chain or cyclic alkyl group containing an alkyloxy group (for example, a methoxy group, an ethoxy group, an isopropoxy group, a cyclohexyloxy group or an octyloxy group, etc.), a substituted or unsubstituted aryloxy group (for example, a phenoxy group, a p-tert-butylphenoxy group or a naphthoxy group, etc.), a N-substituted amino group (for example, a methylamino group, a diethylamino group or an anilino group, etc.), an amido group (for example, an acetamido group, a butylamido group, a methylsulfonamido group or a diacylamino group, etc.), a halogen atom (fluorine, chlorine or bromine, etc.), a hydroxy group, a cyano group or a nitro group. Y represents a substituted or unsubstituted aryl group (for example, a phenyl group, a 2-chlorophenyl group, a 4-chlorophenyl group, a 2,5-dichlorophenyl group, a 2,6-dichlorophenyl group, a 2,4,6-trichlorophenyl group, a 2-bromophenyl group, a 3,5-dibromophenyl group, a 2-cyanophenyl group, a 4-cyanophenyl group, a 3-nitrophenyl group, a 4-nitrophenyl group, a 4-methylphenyl group, a 2,6-dimethylphenyl group, a 2,6-diethylphenyl group, a 4-butylphenyl group, a 2-trifluoromethylphenyl group, a 2-ethoxyphenyl group, a 2-phenylphenyl group, a 4-phenylphenyl group, a 4-phenoxyphenyl group, a 2-chloro-5-cyanophenyl group, a 5-chloro-2-methylphenyl group, a 2,6-dichloro-4-methylphenyl group, a 2-chloro-4,6-dimethylphenyl group, a 2,6-dichloro-4-methoxyphenyl group, a 2,6-dichloro-4-nitrophenyl group, a 2,4,6-trimethyl-3-nitrophenyl group or a 2,4,6-trimethyl-3-nitrophenyl group or a 2,4,6-trimethyl-3-acetamidophenyl group, etc.) or a nitrogen, oxygen and sulfur atom containing heterocyclic group having a 5-membered ring or 6-membered ring (for example, a 2-thiazolyl group, a 2-benzothiazolyl group, a 2-benzoxazolyl group, a 2-oxazolyl group, a 2-imidazolyl group or a 2-benzoimidazolyl group, etc.). W represents a hydrophobic ballast group which preferably has 4 to 35 carbon atoms (more preferably, 8 to 32 carbon atoms) in order to render the coupler non-diffusible, which is linked directly or through an imino bond, an ether bond, a carbonamide bond, a sulfonamide bond, a ureido bond, an ester bond, an imide bond, a carbamoyl bond or a sulfamoyl bond, etc. to the aromatic nucleus of the anilino group. Some examples of the ballast group are as shown in examples of the coupler of the present invention, Examples of the ballast group are as follows.

(i) Alkyl groups and alkenyl groups.

For example, $-CH_2-CH(C_2H_5)_2$, $-C_{12}H_{25}$, $-C_{16}H_{33}$ and $-C_{17}H_{33}$.

(ii) Alkoxyalkyl groups

For example, $-(CH_2)_3-O-(CH_2)_7CH_3$ and $$-(CH_2)_3OCH_2-\underset{\underset{C_2H_5}{|}}{CH}-(CH_2)_8-CH_3$$

as described in Japanese Patent Publication No. 27563/64.

(iii) Alkylaryl groups.

For example,

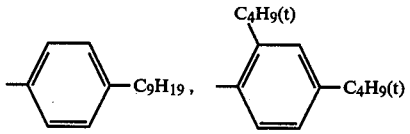

(iv) Alkylaryloxyalkyl groups.

For example,

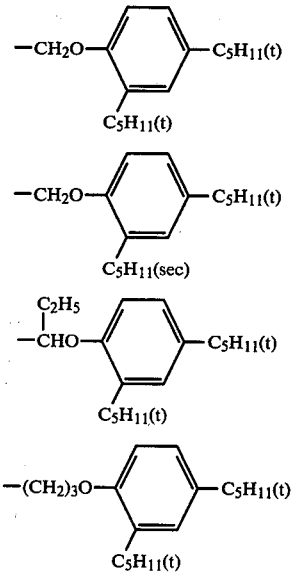

-continued

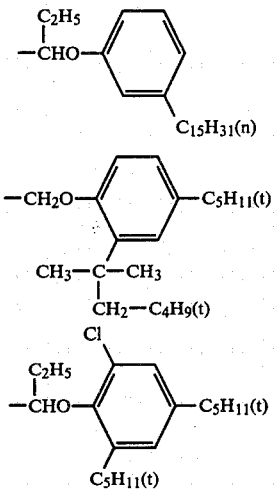

(v) Acylamidoalkyl groups.
For example

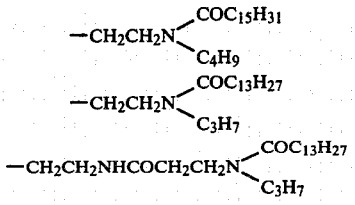

as described in U.S. Pat. Nos. 3,337,344 and 3,418,129

(vi) Alkoxyaryl and aryloxyaryl groups.

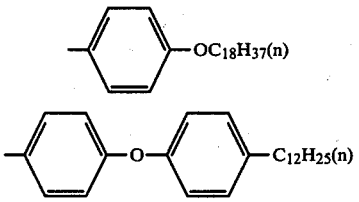

(vii) Groups having both a long chain alkyl or alkenyl group and a water-solubilizing carboxyl or sulfo group.
For example,

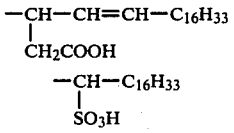

(viii) Alkyl groups substituted by an ester group.

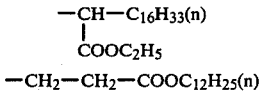

(ix) Alkyl groups substituted by an aryl group or a heterocyclic group.
For example,

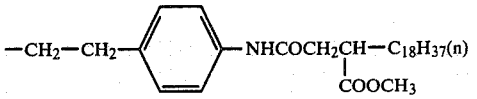

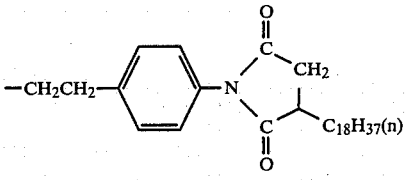

(x) Aryl groups substituted by an aryloxyalkoxycarbonyl group.

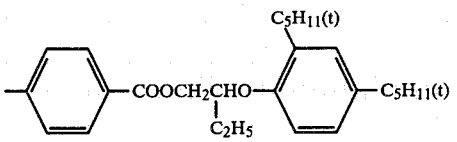

V represents a hydrogen atom or a group defined for X or W. Z represents a hydrogen atom or a group releasable upon a coupling reaction with an oxidized aromatic primary amino color developing agent, namely, a thiocyano group, an acyloxy group (for example, an acetoxy group, a dodecanoyloxy group, an octadecanoyloxy group, a 3-pentadecylphenoxy group, a benzoyloxy group, a β-naphthoyloxy group or a 3-[γ-(2,4-di-tert-amylphenoxy)butyramido]benzoyloxy group, etc.), an aryloxy group (for example, a phenoxy group, a p-chlorophenoxy group, a p-nitrophenoxy group or a naphthoxy group, etc.), an aralkyloxycarbonyl group (for example, a benzyloxycarbonyl group, etc.), an alkyloxycarbonyloxy group (for example, an ethyloxycarbonyloxy group, etc.), a halogen atom (for example, chlorine or fluorine, etc.), a cycloalkoxy group (for example, a cyclohexyloxy group, etc.), an aromatic amino group (for example, a phthalimido group, etc.) or a heterocyclic amino group (for example, a piperidino group, etc.). Further, Z may represent a group which is linked to a coupling position of the so-called colored couplers described in U.S. Pat. Nos. 2,455,170, 2,688,539, 2,725,292, 2,983,608 and 3,005,712 and British Pat. Nos. 800,262 and 1,044,778, etc., a group which is linked to a coupling position of the so-called development inhibiting compound releasable (DIR) couplers described in U.S. Pat. Nos. 3,148,062, 3,227,554 and 3,617,291, etc. or a group which is linked to a coupling position of couplers described in U.S. Pat. Nos. 3,006,759, 3,214,437, 3,311,476 and 3,419,391, etc.

The magenta couplers particularly preferred for use in the present invention an represented by the following formula (III)

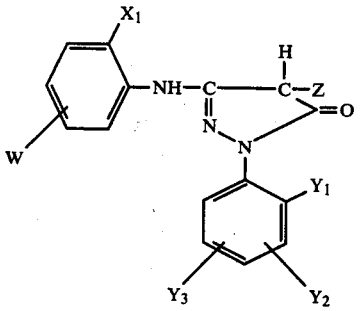

wherein W and Z have the same meaning as defined in the formula (II), $X_1$ represents an alkyl group having 1 to 4 carbon atoms, an alkoxy group having 1 to 4 carbon atoms, a halogen atom, a hydroxy group, a cyano group or a nitro group, and $Y_1$ represents a halogen atom, an alkyl group, an alkoxy group, a carboxyl group, a nitro group, an aryloxy group, a cyano group, an acylamino group, an alkoxycarbonyl group or an aryloxycarbonyl group. $Y_2$ and $Y_3$ may be the same or different and each represent a hydrogen atom or a group defined in $Y_1$. Representative examples of the 3-anilino-5-pyrazolone type magenta couplers useful in the present invention are shown below, however, the present invention is not limited to these alone.

Coupler [A]

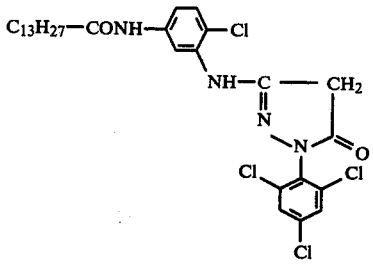

Coupler [B]

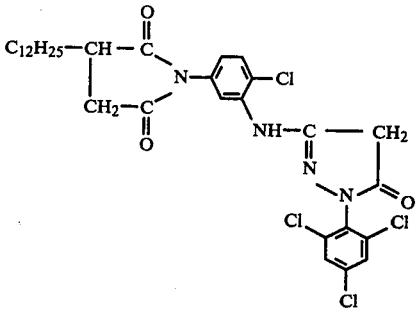

Coupler [C]

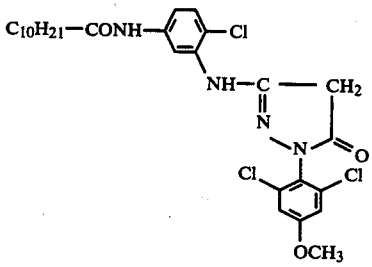

Coupler [D]

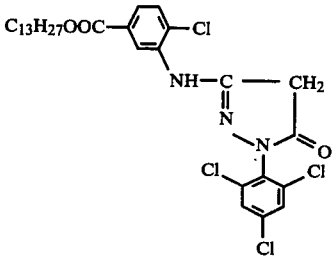

Coupler [E]

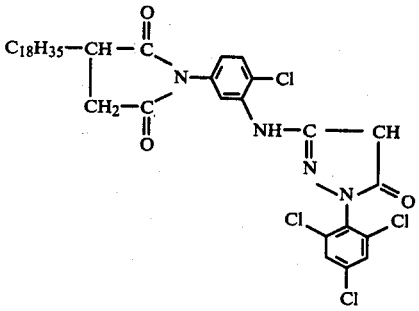

Coupler [F]

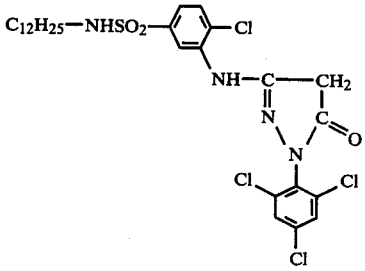

Coupler [G]

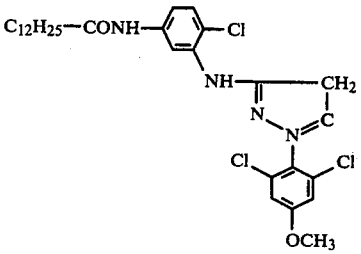

Coupler [H]

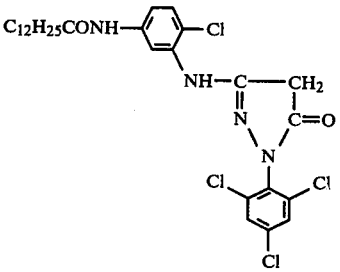

Coupler [I]

Coupler [J]

-continued
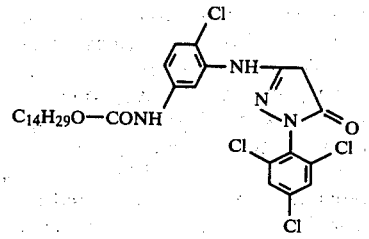
Coupler [K]
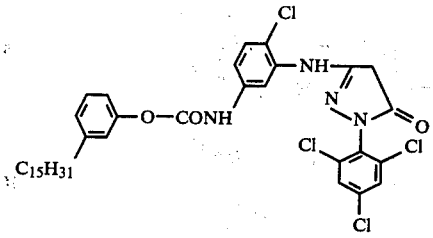
Coupler [L]
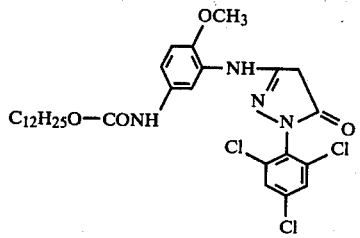
Coupler [M]
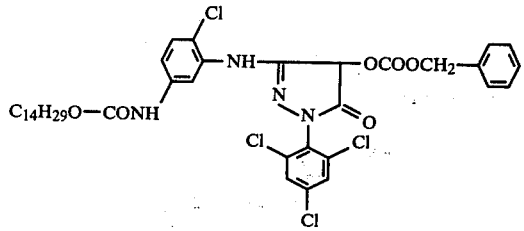
Coupler [N]
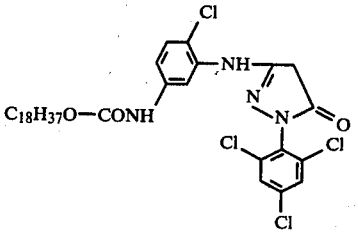
Coupler [O]
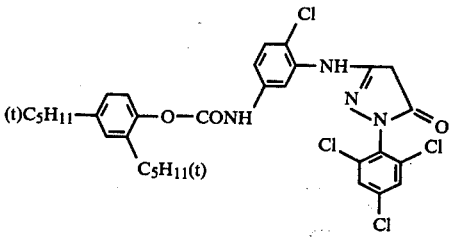
Coupler [P]
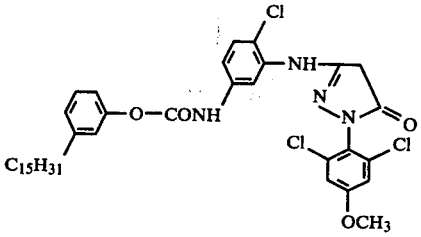
Coupler [Q]
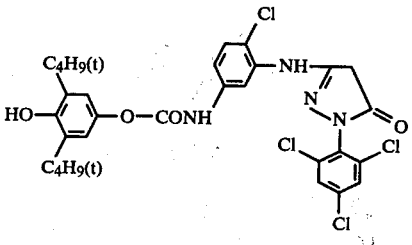
Coupler [R]
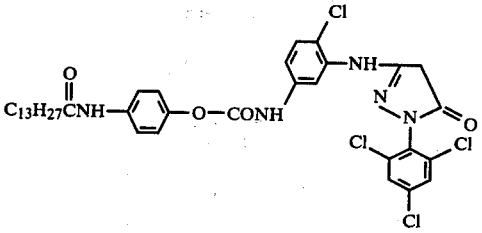
Coupler [S]
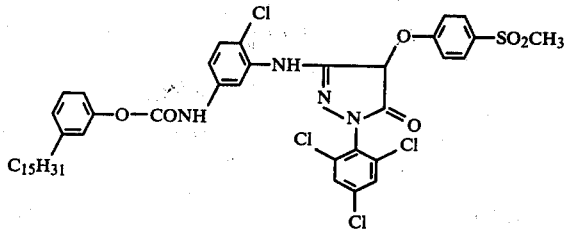
Coupler [T]
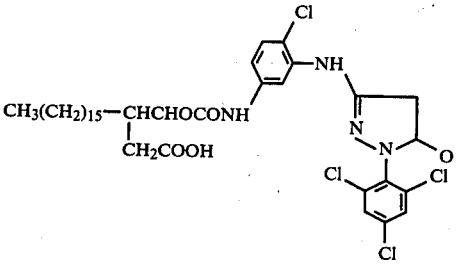
Coupler [U]
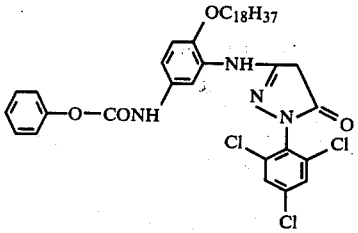
Coupler [V]

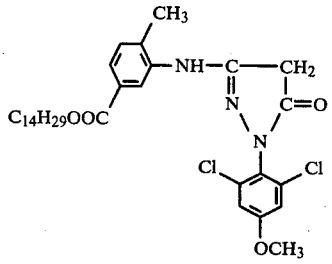

Coupler [W]

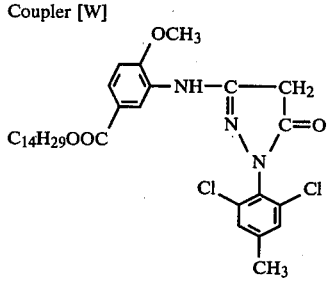

Coupler [Y]

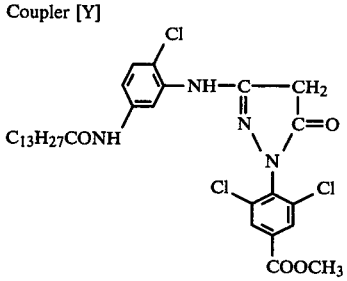

-continued

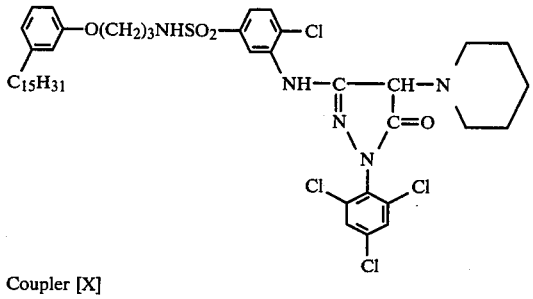

Coupler [X]

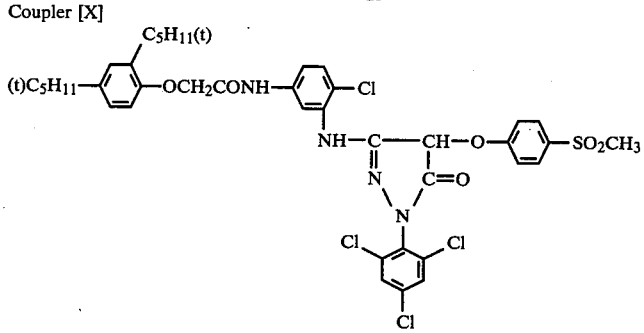

The compounds of formula (I) used in the present invention can be added to the photographic emulsions using well known techniques for coupler additions. Generally these techniques rely upon a high boiling point solvent or a high boiling point solvent and an auxiliary solvent. These solvents may be used for dispersing the compounds alone or together with the coupler.

Representative high boiling point solvents are described in U.S. Pat. No. 3,676,137 and include such solvents as butyl phthalate, dinonyl phthalate, butyl benzoate, diethylhexyl sebacate, butyl stearate, dinonyl maleate, tributyl citrate, tricresyl phosphate or dioctyl butyl phosphate, etc., diethyl succinate, dioctyl adipate, 3-ethylbiphenyl and liquid dye stabilizers described in "Product Licensing Index" Vol. 83, pages 26–29 (Mar. 1971) as "Improved photographic dye image stabilizer", etc. Examples of organic solvents having a low boiling point used as auxiliary solvents together with the organic solvents having a high boiling point include ethyl acetate, butyl acetate, ethyl propionate, ethyl formate, butyl formate, nitromethane, carbon tetrachloride, chloroform, hexane, cyclohexane, ethylene glycol, acetone, ethanol, dimethylformamide and dioxane, etc. Further, benzene, toluene or xylene may be added to these solvents. These solvents are only an example and the present invention is not limited to them.

Surface active agents may be used to disperse the solution prepared by dissolving the compounds of the formula (I) alone or together with the coupler in an aqueous solution of a protective colloid. Representative examples include saponin, sodium alkylsulfosuccinate and sodium alkylbenzene sulfonate, etc. Examples of the hydrophilic protective colloids include gelatin, casein, carboxymethylcellulose, polyvinyl alcohol, polyvinyl pyrrolidone, styrene-maleic acid anhydride copolymer, condensates of styrene-maleic acid anhydride copolymer and polyvinyl alcohol, polyacrylates and ethylcellulose, etc. However, the present invention is not limited to these.

The emulsion layer of the present invention, may incorporate known magenta couplers besides the 3-anilino-5-pyrazolone coupler. Examples of these magenta couplers include pyrazolone type compounds, imidazolone type compounds and cyanoacetyl compounds. It is particularly advantageous to use pyrazolone type compounds. Examples of the magenta couplers include compounds described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication Nos. 6031/65 and 45990/76 and Japanese Patent Application (OPI) Nos. 20826/76, 58922/77, 129538/74, 74027/74, 159336/75, 42121/77, 74028/74, 60233/75 and 26541/76.

In the other light-sensitive layers of color photographic materials embodying the present invention, the following couplers are used besides the magenta couplers. Closed ring ketomethylene type compounds are generally used as yellow couplers. Examples include the compounds described in U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194 and German Patent Application (OLS) Nos. 2,057,941, 2,213,461, 2,219,917, 2,261,361 and 2,263,875, etc.

Phenol or naphthol derivatives are mainly used as cyan couplers. Examples include the compounds described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971 and 3,933,500, German Patent Application (OLS) No. 2,163,811, Japanese Patent Publication No. 28836/70, etc.

It is also possible to use colored couplers such as described in U.S. Pat. Nos. 3,476,560, 2,521,908, and 3,034,892, Japanese Patent Publication Nos. 2016/69, 22335/63, 11304/67 and 32461/69, Japanese Patent Application (OPI) Nos. 26034/76 and 42121/77 and German Patent Application (OLS) No. 2,418,959.

It is also possible to use DIR couplers such as those described in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77, 122335/74 and 69624/77 and Japanese Patent Publication No. 16141/76.

The emulsion layers in the present invention may contain compounds which release a development inhibitor upon development in addition to the DIR couplers. For example, it is possible to use compounds described in U.S. Pat. Nos. 3,297,445 and 3,379,529 and German Patent Application (OLS) No. 2,417,914.

It is possible to incorporate two or more of the above described couplers in the same layer.

In the present invention, an ultraviolet ray absorption layer is preferably used, because fading and discoloration by light are more effectively improved.

Further, the present invention is not restricted with respect to the kind of color processing agents used. Conventional agents may be used such as conventional color developers, bleaching agents stabilizers, etc. Moreover the present invention is not restricted with respect to the use of intensifiers such as described in German Patent Application (OLS) No. 181,390, Japanese Patent Application (OPI) No. 9728/73 and U.S. Pat. No. 4,043,814.

In addition, the processes for preparing photographic silver halide emulsions and the photographic additives used in the color sensitive materials of the present invention, are not restricted. It is possible to utilize the types of emulsions, water washings, chemical sensitization, antifogging agents and stabilizers, hardening agents, bases, plasticizers and lubricants, coating assistants, matting agents, sensitizers, spectral sensitizers, method of addition, absorption or filter dyes and methods of coating, etc. described in *Research Disclosure* No. 92 (Dec. 1971), pages 107–110.

The present invention will be described in more detail in the following examples.

EXAMPLE 1

10 g of magenta compler: 1-(2,4,6-trichlorophenyl)-3-{(2-chloro-5-tetradecanamido)anilino}-2-pyrazolin-5-one (Compound A) was dissolved in a mixture of 20 ml of tricresylphosphate and 20 ml of ethyl acetate. The solution was emulsified by dispersing 80 g of a 10% solution of gelatin containing 8 ml of a 1% aqueous solution of sodium dodecylbenzenesulfonate. Then, the resulting emulsified dispersion was mixed with 145 g of a green-sensitive silver chlorobromide emulsion (Br: 50% by mol) (containing 7 g of Ag), and sodium dodecylbenzenesulfonate was added thereto as a coating assistant.

The emulsion was applied to a paper base the both surfaces of which were laminated with polyethylene (Sample A). The amount of the coupler coated in Sample A was 400 mg/m$^2$.

Samples B to G were produced by the same manner as in Sample A except that 3 g of the compound of the present invention or a comparison compound as shown in Table 1 was added at preparation in the same manner.

These samples were exposed to light at 1000 lux for 1 second and processed with the following processing solutions.

| Developing Solution: | |
|---|---|
| Benzyl Alcohol | 15 ml |
| Diethylenetriaminepentaacetic Acid | 5 g |
| KBr | 0.4 g |
| $Na_2SO_3$ | 5 g |
| $Na_2CO_3$ | 30 g |
| Hydroxylamine Sulfate | 2 g |
| 4-Amino-3-methyl-N-ethyl-N-β(methanesulfonamide)ethylaniline . $3/2H_2SO_4$ . $H_2O$ | 4.5 g |
| Water to make 1 l | pH: 10.1 |

| Bleach-fixing solution: | |
|---|---|
| Amonium Thiosulfate (70 wt. %) | 150 ml |
| $Na_2SO_3$ | 5 g |
| Na(Fe(EDTA)) | 40 g |
| EDTA | 4 g |
| Water to make 1 l | pH: 6.8 |

| Processing: | Temperture | Time |
|---|---|---|
| Developing | 33° C. | 3.5 minutes |
| Bleach-fixing | 33° C. | 1.5 minutes |
| Water wash | 28 to 35° C. | 3 minutes |

Each sample having the resulting dye image was subjected to a fading test for 5 days by means of a xenon tester (illuminance: 200,000 luxes) using an ultraviolet ray absorption filter produced by Fuji Photo Film Co. which cut rays of 400 nm and less. The measurement was carried out by means of a Macbeth densitometer RD-514 (status AA filter), and the change in the density in areas having an initial magenta density of 2.0 was measured.

TABLE I

| Sample | Dye Image Stabilizer | Change in Yellow Density in White Areas | Change in Magenta Density | Note |
|---|---|---|---|---|
| A | — | +0.26 | −1.23 | Comparison |
| B | Compound (3) | +0.04 | −0.18 | Invention |
| C | Comparison compound (a) | +0.04 | −0.52 | Comparison |
| D | Comparison compound (b) | +0.16 | −0.76 | Comparison |
| E | Compound (5) | +0.08 | −0.30 | Invention |
| F | Compound (11) | +0.08 | −0.32 | Invention |
| G | Comparison | +0.17 | −0.96 | Comparison |

TABLE I-continued

| Sample | Dye Image Stabilizer | Change in Yellow Density in White Areas | Change in Magenta Density | Note |
|---|---|---|---|---|
| | compound (c) | | | |

Comparison (a)

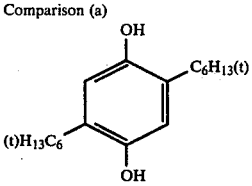

Comparison compound (b)

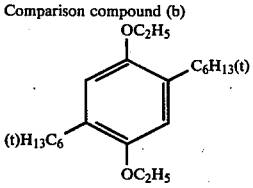

Comparison Compound (c)

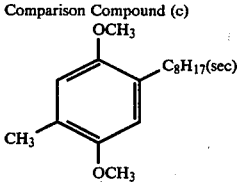

It is understood from this result that the compounds used in the present invention are effective for preventing fading of dye images and effective for preventing yellowing of white areas by light. Particularly, Compound (3) shows noticeable effects.

EXAMPLE 2

A coating composition for the third layer having a composition shown in the following Table III was prepared using the same compound as in Example 1 as a magenta coupler according to the process for producing Sample A in Example 1, and multilayer sample (Sample H) containing the third layer shown in Table III was produced. Further, multilayer samples (Samples I and J) were produced according to Sample H except that Compound (3) of the present invention was used in an amount of 3 g or 6 g based on 10 g of the same coupler. Further, samples of the present invention and comparative examples as shown in Table II were produced. These samples were exposed to light and developed in the same manner as in Example 1 to form images. Each sample was examined for 4 weeks by a fluorescent light fading tester (20,000 lux). The results are shown in Table II.

TABLE II

| Sample | Dye Image Stabilizer | Amount/ 10 g of coupler | Change in Magenta Density (Density 1.0) | Note |
|---|---|---|---|---|
| H | — | — | −0.85 | Comparison |
| I | Compound (3) | 3 g | −0.18 | Invention |
| J | Compound (3) | 6 g | −0.08 | Invention |
| K | Comparison compound (a) | 3 g | −0.26 | Comparison |
| L | Compound (3)<br>Comparison compound (a) | 3 g<br>3 g | −0.12 | Invention |
| M | Comparison compound (b) | 3 g | −0.45 | Comparison |

It is understood from these results that the compounds used in the present invention are effective for preventing fading of dye images and that this effect is enhanced as the amount added increases, and it becomes more remarkable by using compounds of formula (I) together with the known fading inhibitor such as Comparison compound (a).

TABLE III

| | |
|---|---|
| 6th layer (Protective layer) | Gelatin (amount: 1000 mg/m$^2$) |
| 5th layer (Red-sensitive layer) | Silver chlorobromide emulsion (Br: 50% by mol; amount: silver 300 mg/m$^2$).<br>Gelatin (amount: 1000 mg/m$^2$).<br>Cyan coupler (*1) (Amount: 400 mg/m$^2$).<br>Coupler solvent (*2) (Amount: 200 mg/m$^2$). |
| 4th layer (Intermediate layer) | Gelatin (amount: 1200 mg/m$^2$).<br>Ultraviolet ray absorbing agent (*3) (amount: 1000 mg/m$^2$).<br>Solvent for ultraviolet ray absorbing agent (*2) (amount: 250 mg/m$^2$). |
| 3rd layer (Green-sensitive layer) | Silver chlorobromide emulsion (Br: 50% by mol; amount: silver 290 mg/m$^2$).<br>Gelatin (amount: 1000 mg/m$^2$).<br>Magenta coupler (*4) (amount: 200 mg/m$^2$).<br>Coupler solvent (*5) (amount: 200 mg/m$^2$). |
| 2nd layer (Intermediate layer) | Gelatin (amount: 1000 mg/m$^2$) |
| 1st layer (Blue-sensitive layer) | Silver chlorobromide emulsion (Br: 80% by mol; amount: silver 400 mg/m$^2$).<br>Gelatin (amount: 1200 mg/m$^2$).<br>Yellow coupler (*6) (amount: 300 mg/m$^2$).<br>Coupler solvent (*7) (amount: 150 mg/m$^2$) |
| Base | Paper base the both surfaces of which are laminated with polyethylene |

(*1) Coupler: 2-[α-(2,4-di-tert-pentylphenoxy)butanamido]-4,6-dichloro-5-methylphenol. dichloro-5-methylphenol.

(*2) Solvent: Dibutylthalate.

(*3) Ultraviolet ray absorbing agent: 2-(2-hydroxy-3-sec-butyl-5-tert-butylphenyl)-benzotriazole.

(*4) Coupler: 1-(2,4,6-Trichlorophenyl)-3-(2-chloro-5-tetradecanamide)anilino-2-pyrazoline-5-one.

(*5) Solvent: Tricresyl phosphate (*6) Coupler: α-Pivaloyl-α-(2,4-dioxo-5,5'-dimethyloxazolidin-3-yl)-2-chloro-5-[α-(2,4-di-tert-pentylphenoxy)-butanamide]acetanilide.

(*7) Solvent: Dioctylbutyl phosphate.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon a silver halide emulsion layer containing a 3-anilino-5-pyrazolone type magenta coupler and at least one of the compounds represented by the formula (I)

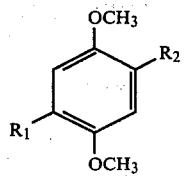

(I)

wherein $R_1$ and $R_2$ represent each a tertiary alkyl group having 4 to 20 carbon atoms.

2. The color photographic material of claim 1, wherein $R_1$ and $R_2$ are t-hexyl groups.

3. The color photographic material of claim 1, wherein $R_1$ and $R_2$ represent 1,1,3,3-tetramethylbutyl groups.

4. The color photographic material of claim 1, wherein said compound of the formula (I) is present in an amount of about 0.5 to 200 wt.% based on the weight of the coupler.

5. The color photographic material of claim 1, wherein said emulsion layer additionally contains a conventional fade inhibitor.

6. The color photographic material of claim 1, wherein said magenta coupler is represented by the formula (II)

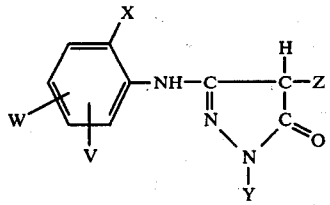

(II)

wherein X represents an alkyl group, an aryl, an alkoxy group, an aryloxy group, an N-substituted amino group, an amido group, a hydroxy group, a cyano group, a nitro group, or a halogen atom, Y represents an aryl group, or a 5- or 6-membered heterocyclic ring, W represents a ballast group, V represents a hydrogen atom or a group defined for X or W, and Z represents a hydrogen atom or a group which is released upon coupling reaction with an oxidized aromatic primary amino color developing agent.

7. The color photographic material of claim 6 wherein said couplers are represented by the formula (III)

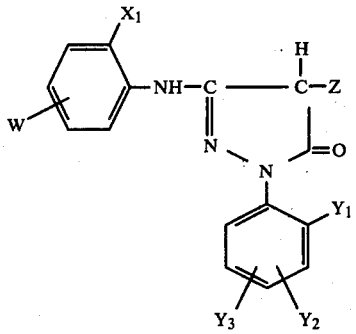

wherein W and Z have the same meaning as defined in the formula (II), $X_1$ represents an alkyl group having 1 to 4 carbon atoms, an alkoxy group having 1 to 4 carbon atoms, a halogen atoms, a hydroxy group, a cyano group or a nitro group, and $Y_1$ represents a halogen atom, an alkyl group, an alkoxy group, a carboxyl group, a nitro group, an aryloxy group, a cyano group, an acylanino group, an alkoxycarbonyl group or an aryloxycarbonyl group $Y_2$ and $Y_3$ may be the same or different and each represent a hydrogen atom or a group defined in $Y_1$.

* * * * *